US006250338B1

(12) United States Patent
Dempsey

(10) Patent No.: US 6,250,338 B1
(45) Date of Patent: Jun. 26, 2001

(54) COMPOSITE FAUCET HOSE WEIGHT

(75) Inventor: James F. Dempsey, North Olmsted, OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/515,606

(22) Filed: Feb. 29, 2000

(51) Int. Cl.[7] ..... E03C 1/02

(52) U.S. Cl. ..... 138/103; 4/678; 137/801; 239/588

(58) Field of Search ..... 4/678; 137/801; 138/103; 239/588

(56) References Cited

U.S. PATENT DOCUMENTS 3,180,051 * 4/1965 Freeman ..... 43/43.12
4,827,538 5/1989 Heimann et al. .
5,090,062 2/1992 Hockstrasser .
5,095,554 3/1992 Gloor .
5,361,431 11/1994 Freier et al. .
5,575,424 11/1996 Fleischmann .
5,771,934 6/1998 Warshawsky .
5,960,832 10/1999 Warshawsky .

* cited by examiner

*Primary Examiner*—Gerald A. Michalsky
(74) *Attorney, Agent, or Firm*—Cook, Alex, McFarron, Manzo, Cummings & Mehler, Ltd.

(57) ABSTRACT

A hose weight includes two identical and interchangeable interlocking bodies. Each body includes a hose receiving chamber and portions of an interlock for use with another like body. The interlock of each body includes a recess positioned on one side of a hose receiving chamber and a projection on the opposite side of the hose receiving chamber. The interlock may also include one or more pairs of openings and posts to assist in guiding the bodies together to form an interlock. The two bodies join together around a hose without the use of tools to form a single hose weight.

16 Claims, 1 Drawing Sheet

COMPOSITE FAUCET HOSE WEIGHT

FIELD OF THE INVENTION

The present invention relates to a hose weight for use with a faucet spray hose. Hose weights are used with spray hoses to provide a counterweight which pulls the hose back below the deck of the faucet when the user has finished using the hose. Prior art hose weights were comprised of as many as six separate pieces. Typical hose weights use threaded fasteners for assembly which add to the number of parts. The parts also are not interchangeable so plumbers have to make sure that they have the proper parts for assembly. Further, plumbers usually assemble hose weights underneath the sink in hard-to-reach compartments which makes assembly with threaded fasteners a nuisance. Thus, there is a need for an easy to assemble hose weight comprised of identically shaped, interchangeable parts.

The present invention provides for a faucet hose weight which requires only two identically-shaped and interchangeable parts. The two parts form an interlocking hose weight which secure around a hose for easy installation.

SUMMARY OF THE INVENTION

The present invention relates to a faucet hose weight formed entirely by two identical and interlocking parts.

A primary purpose of the invention is to provide a hose weight which is formed from two identical parts which join together about the hose of a pull out faucet or faucet side spray.

Another purpose of the invention is to provide a hose weight which is formed from two parts each of which have a portion of an interlock such that when joined form a locking engagement around the hose.

Another purpose of the invention is to provide a hose weight which can be easily installed by securing two symmetrical interlocking pieces together around the hose without tooling.

Another purpose of the invention is to provide a hose weight which is secured around the hose without crimping.

Yet another purpose of the invention is to provide a molded nonmetallic hose weight which is durable and cost effective.

Other purposes will appear in the ensuing specification, drawings and claims.

BRIEF DESCRIPTION OF THE DRAWINGS

The invention is illustrated diagrammatically in the following drawings wherein.

DETAILED DESCRIPTION OF THE PREFERRED EMBODIMENT

Figure 1:
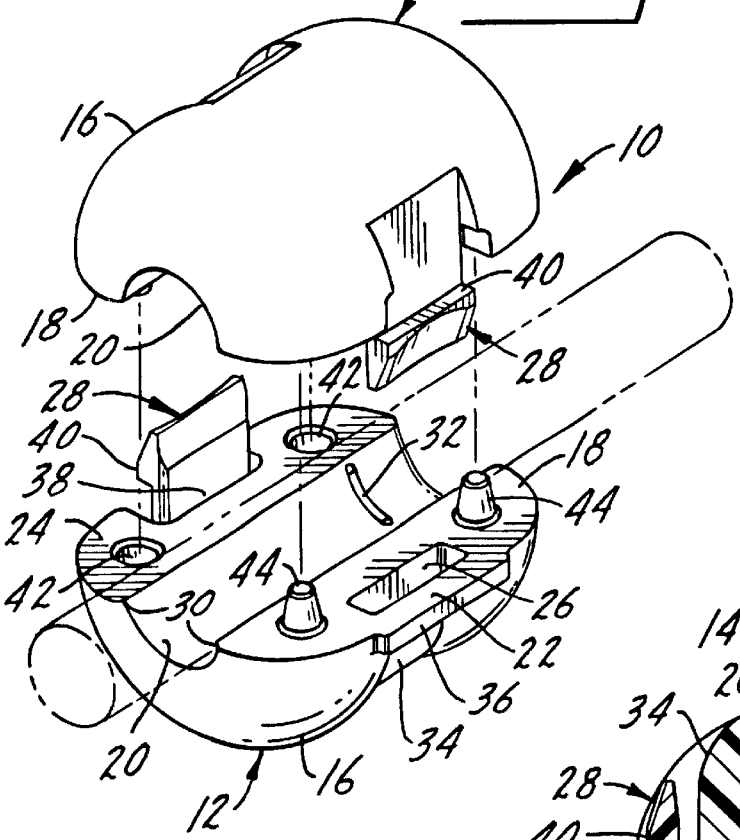
FIG. 1 is an expanded perspective view of the hose weight of the present invention.
Figure 3:
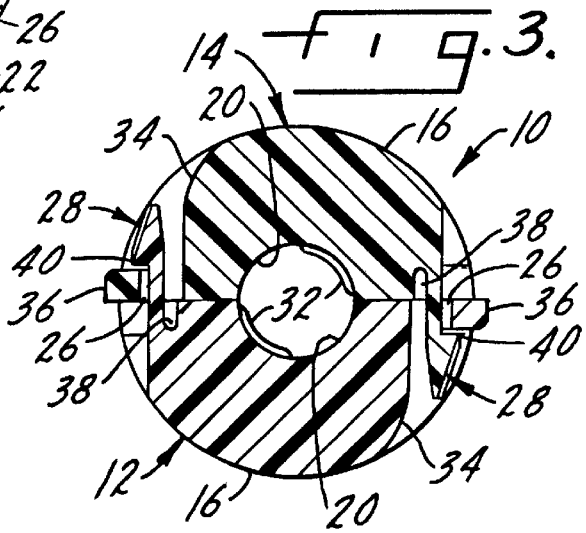
FIG. 3 is a section taken along plane 3—3 in FIG. 2.
Figure 2:
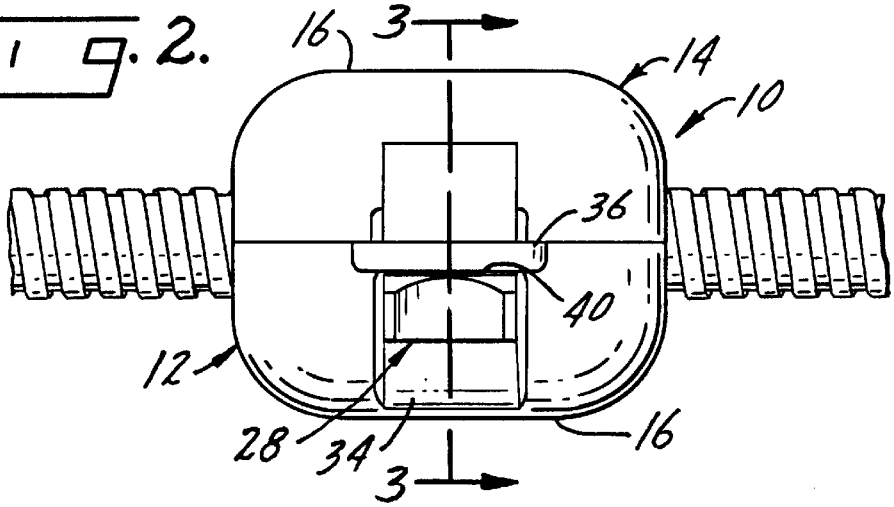
FIG. 2 is a side view of the hose weight attached to a hose.

FIGS. 1, 2 and 3 illustrate a faucet hose weight 10 of the present invention. The hose weight 10 is comprised from two interlocking symmetrical parts or halves, which will be referred to as a first and second body 12, 14. As both parts 12 and 14 are identical, only one will be described in detail and like numbers will be applied to the same elements on both. Each body includes an outer surface 16, an inner surface 18, a portion of a hose receiving chamber 20, a pair of oppositely extending generally flat surfaces 22, 24, an interlocking recess 26 and an interlocking headed projection 28.

The outer surface 16 of the body 12 is generally curved. When the first and second bodies 12, 14 are joined together, the hose weight 10 forms a shape which is primarily cylindrical. The hose receiving chamber 20 is a semi-circular opening along the length of the body 12. The pair of oppositely extending flat surfaces 22, 24 extend outwards from the edges 30 of the hose receiving chamber 20 to the periphery of the body 12. The hose receiving chamber 20 may also have a plurality of arcuate ribs 32 which grip the hose when bodies 12 and 14 are secured around the hose. Thus, the ribs 32 assist in keeping the hose from sliding along the length of the hose without crimping the hose.

The interlocking portions of the body 12 includes the recess 26 and the projection 28 which are positioned on the opposite sides of the hose chamber 20. FIG. 1 shows the recess 26 disposed on the surface 22 and projection 28 is extending from the surface 24. The recess 26 extends completely through body 12 as shown in FIG. 3. There is a groove 34 in alignment with the recess 26 and a flange 36 extends slightly outwardly from the outer surface 16 in alignment with the groove 34 and the recess 26. The projection 28 extends outwardly from surface 24 and there may be a peripheral recess 38 in the body about the projection to provide flexure to the projection when assembling and disassembling the hose weight. The groove 34 in the outer surface 16 of the body 12 is in alignment with projection 28. The projection 28 has a hook 40 at its end which will extend through the recess 26 and overlie the flange 36 as particularly shown in FIG. 3 which illustrates the two identical bodies assembled into a unitary hose weight.

In use the hose weight is assembled by securing the first body to the second body around the hose. The symmetrical and identical bodies face one another on opposite sides of the hose. When the bodies are moved together, each projection 28 will pass through an aligned recess 26. The projections will each flex an amount sufficient for each hook 40 to pass by a flange 36, after which the projections will return to a position in which the hooks overlie the flanges, securing the bodies together.

The interlocking portions of each body 12, 14 may further include one or more pairs of openings 42 and guiding posts 44 which help guide the two bodies together to form an interlock. The openings 42 and the posts 44 are positioned on the extending flat surfaces 22, 24 and are aligned in such a way that each post of one body fits within an opening on the other body when the bodies 12, 14 are in a locking arrangement. Although FIG. 1 shows two pairs, it is understood that any number may be used in any orientation or size.

The hose weight presents significant advantages. Because the hose weight comprises two identical pieces which fit together to form one integral weight, only one type of part is needed for inventory and installation. There is no longer a need to keep multiple types of parts. Further, the hose weight can be easily secured around the hose without tools. No additional locking mechanisms are needed. Installation time is significantly reduced. The hose is usable with pull out faucet wands or separate kitchen deck side sprays.

The bodies 12, 14 may be made of a nonmetallic molded material. It is understood that the material is of sufficient density to provide a counterweight to the hose. Using a nonmetallic material provides a cost advantage over metal counterweights. The nonmetallic material provides a sturdy shape while also providing a certain degree of flexibility. Each body is produced from a single mold which incorporates all the interlocking features.

Although the bodies have been described as identical, it is also possible to provide a hose weight utilizing the interlocking feature which is not identical. One body may have two projections whereas the other body may have two recesses. Similarly, the bodies may have nonidentical combinations of posts and openings to guide the bodies together.

Whereas the preferred form of the invention has been shown and described herein, it should be realized that there may be many modifications, substitutions and alterations thereto.

What is claimed is:

1. A hose weight for use with a pull out faucet hose comprising:

a first body and a second body, each of which are identical and interchangeable, each body having a portion of a hose receiving chamber, each body having means thereon for forming an interlock with another like body, about a hose and without the use of tools.

2. The hose weight of claim 1 wherein said means for forming an interlock includes a recess on one side of each body hose receiving chamber and a projection on the opposite side of each hose receiving chamber.

3. The hose weight of claim 2 wherein a peripheral recess is positioned around each projection.

4. The hose weight of claim 2 wherein each body has a flange which is aligned with the recess.

5. The hose weight of claim 4 wherein a groove in an outer surface of each body aligns with the recess and the flange.

6. The hose weight of claim 5 wherein the projection has a hook on an outwardly extending end thereof for overlying the flange when the first and second bodies are secured together.

7. The hose weight of claim 2 wherein the recess extends completely through each body.

8. The hose weight of claim 2 wherein the means for forming an interlock further includes at least one pair of an opening and a post, the opening being located on one side of each body hose receiving chamber and the post being located on the opposite side of the body hose receiving chamber.

9. The hose weight of claim 8 wherein each body has at least two pairs of an opening and a post.

10. The hose weight of claim 1 further comprising a plurality of arcuate ribs along each body hose receiving chamber for gripping the hose therein.

11. The hose weight of claim 1 wherein the first body and second body are molded from a high density nonmetallic material.

12. A hose weight for use with a pull out faucet hose comprising:

a first body and a second body, each body having a portion of a hose receiving chamber and a portion of an interlock, the interlock includes a projection on one side of the first body hose receiving chamber and a recess on one side of the second body hose receiving chamber, the projection and the recess forming an interlock about a hose without the use of tools.

13. The hose weight of claim 12 wherein the interlock of each body includes a projection on one side of each body hose receiving chamber and a recess on the opposite side of each hose receiving chamber.

14. The hose weight of claim 13 wherein the first body and the second body are identical and interchangeable.

15. The hose weight of claim 12 further comprising at least one opening positioned on one side of the first body hose receiving chamber and at least one post positioned on one side of the second body hose receiving chamber.

16. The hose weight of claim 15 wherein each body includes at least one opening positioned on one side of the body hose receiving chamber and at least one post positioned on the opposite side of the body receiving chamber.

* * * * *